US009548031B2

(12) United States Patent
Shin et al.

(10) Patent No.: US 9,548,031 B2
(45) Date of Patent: Jan. 17, 2017

(54) DISPLAY DEVICE CAPABLE OF DRIVING AT LOW SPEED

(71) Applicant: LG Display Co., Ltd., Seoul (KR)

(72) Inventors: Seunghwan Shin, Suncheon-si (KR); Yonghwa Park, Paju-si (KR); Daeseok Oh, Paju-si (KR); Moonsoo Chung, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 202 days.

(21) Appl. No.: 14/308,387

(22) Filed: Jun. 18, 2014

(65) Prior Publication Data

US 2015/0187308 A1 Jul. 2, 2015

(30) Foreign Application Priority Data

Dec. 31, 2013 (KR) ..... 10-2013-0168586

(51) Int. Cl.
*G09G 3/26* (2006.01)
*G09G 3/36* (2006.01)
*G09G 3/20* (2006.01)

(52) U.S. Cl.
CPC ..... *G09G 3/3614* (2013.01); *G09G 3/2022* (2013.01); *G09G 3/3688* (2013.01); *G09G 2310/0218* (2013.01); *G09G 2310/0224* (2013.01); *G09G 2310/08* (2013.01); *G09G 2320/0233* (2013.01); *G09G 2320/0247* (2013.01); *G09G 2330/021* (2013.01); *G09G 2340/0435* (2013.01)

(58) Field of Classification Search
None
See application file for complete search history.

(56) References Cited

U.S. PATENT DOCUMENTS

2010/0220095 A1* 9/2010 Chiu ..... G09G 3/3688 345/214
2014/0118657 A1* 5/2014 Duan ..... G02F 1/136286 349/46
2014/0152634 A1* 6/2014 Shibata ..... G09G 3/3614 345/209
2015/0310814 A1* 10/2015 Umekida ..... G09G 3/3611 345/690

* cited by examiner

*Primary Examiner* — Seokyun Moon
*Assistant Examiner* — Douglas M Wilson
(74) *Attorney, Agent, or Firm* — Fenwick & West LLP

(57) ABSTRACT

A display device capable of driving at low speed is disclosed. Pixels connected to a first data line on odd-numbered display lines of a display panel are positioned on one side of the left and right sides of the first data line, and pixels connected to the first data line on even-numbered display lines of the display panel are positioned on the other side of the first data line based on a Z-inversion scheme. When a mode conversion control signal for switching to an interlaced low speed driving mode is input during a normal drive, in which a length of one frame is set to P, a timing controller expands a length of one frame for a low speed drive to (n×P), where n is a positive integer equal to or greater than 2 and assigns a length P to each of n sub-frames of the one frame.

20 Claims, 16 Drawing Sheets

<30Hz Flicker component>

DISPLAY DEVICE CAPABLE OF DRIVING AT LOW SPEED

CROSS-REFERENCE TO RELATED APPLICATION

This application claims the benefit of Korea Patent Application No. 10-2013-0168586 filed on Dec. 31, 2013, which is incorporated herein by reference for all purposes as if fully set forth herein.

BACKGROUND

Technical Field

Embodiments of the disclosure relate to a display device capable of driving at low speed.

Discussion of the Related Art

Display devices have been used in various display units, such as portable information devices, office devices, computers, and televisions.

Methods for reducing power consumption of the display device include low speed driving technology. The low speed driving technology is to change a frame frequency (e.g., a driving frequency) based on a change in the amount of data. In a stop image, in which there is no change of data, the low speed driving technology refreshes the screen of the display device using a frame frequency less than an input frame frequency (for example, a normal frame frequency of 60 Hz). In a moving image in which there is a change in data, the screen of the display device is refreshed using a normal driving method based on the input frame frequency. The display device may change the frame frequency in response to a panel self refresh (PSR) control signal received from a system. For example, when the PSR control signal is input at an on-level in conformity with the stop image, the display device may reduce the frame frequency to a frequency less than 60 Hz. Further, when the PSR control signal is input at an off-level in conformity with the moving image, the display device may keep the frame frequency at 60 Hz.

The low speed driving technology may be implemented through an interlaced driving scheme. In the interlaced low speed driving scheme, one frame is time-divided into a plurality of sub-frames, and gate lines are interlace-driven in each sub-frame. In the interlaced driving scheme, as the number of sub-frames increases, a length of one frame increases. Hence, the frame frequency is reduced. As the frame frequency gradually decreases from 60 Hz for the low speed drive, a data transition frequency (used in the supply of a data voltage) of a source driver decreases. Hence, power consumption is reduced.

As shown in FIG. 2, the display device adopting the interlaced low speed driving scheme may design a connection structure of pixels in a Z-inversion scheme and may control polarities of data voltages output from a source driver in a column inversion scheme, as a method for reducing power consumption. In FIG. 2, reference numerals D1 to D5 denote data lines to which the data voltage is supplied, and reference numerals G1 to G4 denote gate lines to which a scan pulse is supplied. In the pixel connection structure of the Z-inversion scheme, each of the pixels on odd-numbered display lines may be connected to the data line through a thin film transistor (TFT) and may be disposed on the right side of the data line, and each of the pixels on even-numbered display lines may be connected to the data line through the TFT and may be disposed on the left side of the data line. The source driver increases a polarity inversion period of the data voltage output through one output channel to one frame using the column inversion scheme, as illustrated by polarity reversals D1(−), D2(+), D3(−), and so on. Thus, the pixels, which are disposed in a zigzag shape based on the same data line (for example, D2) in a vertical direction, receive the data voltage of the same polarity. The display device may reduce the power consumption while controlling a display polarity in a dot inversion scheme based on the pixel connection structure and a polarity control method of the data voltage.

The related art display device has the following problems.

First, in the related art display device, when a normal driving mode is converted into an interlaced low speed driving mode and vice versa while displaying the same pattern of a single color, the data transition changes due to a difference between the driving modes. Hence, a luminance deviation is perceived. For example, as shown in FIG. 3A, when a green pattern is displayed in 60 Hz normal driving mode (as indicated by the non-hashed portions of the subframes corresponding to the G subpixel), the data voltage supplied through the data lines D2 and D5 alternately has a white gray level and a black gray level in a cycle of one horizontal period. On the other hand, as shown in FIG. 3B, when a green pattern is displayed in 30 Hz interlaced low speed driving mode (as indicated by the non-hashed portions of the subframes corresponding to the G subpixel), the data voltage supplied through the data lines D2 and D5 is kept at the white gray level (+) during a first sub-frame period and then is kept at the black gray level (Vcom) during a second sub-frame period. In FIGS. 3A and 3B, the white gray level is represented by a white pattern, and the black gray level is represented by an oblique line pattern. Because the transition number of data in FIG. 3B is less than the transition number of data in FIG. 3A, a charge amount of data in FIG. 3B is more than a charge amount of data in FIG. 3A. Thus, although the data voltage of the same gray level is applied in FIGS. 3A and 3B, a display luminance in FIG. 3B is greater than a display luminance in FIG. 3A.

Second, as shown in FIG. 2, in the related art display device, a parasitic capacitance Cgs varies depending on an overlap degree between source electrodes and gate electrodes of the TFTs on odd-numbered display lines and even-numbered display lines. A kickback voltage $\Delta Vp$ applied to a pixel voltage of the odd-numbered display lines is different from a kickback voltage $\Delta Vp$ applied to a pixel voltage of the even-numbered display lines due to a deviation of the parasitic capacitance Cgs. As a result, the same pixel voltage is applied to the odd-numbered display line and the even-numbered display line, a hold voltage level of the odd-numbered display line is different from a hold voltage level of the even-numbered display line. This is perceived as 30 Hz flicker as shown in FIG. 4. This problem is applied to the interlaced low speed driving mode of the frame frequency less than 30 Hz as well as the frame frequency of 30 Hz. As the frame frequency is lowered, visibility of the flicker increases.

SUMMARY

Embodiments of the disclosure provide a display device capable of driving at low speed, which changes a frame frequency in response to a mode conversion control signal received from the outside, capable of minimizing visibility of a luminance deviation when a driving mode is converted while displaying the same pattern of a single color, and minimizing visibility of a flicker in an interlaced low speed driving state.

In one aspect, a display device capable of driving at low speed changes a frame frequency in response to a mode conversion control signal received from the outside. The display device comprises a display panel, on which a plurality of pixels are formed, pixels connected to one data line on odd-numbered display lines of the display panel being positioned on one side of the left and right sides of the one data line based on a Z-inversion scheme, pixels connected to the one data line on even-numbered display lines of the display panel being positioned on the other side of the one data line based on the Z-inversion scheme. The display device further comprises a driver unit configured to drive the plurality of pixels. The display device also comprises a timing controller configured to, when the mode conversion control signal for switching to an interlaced low speed driving mode is input during a normal drive, in which a length of one frame is set to P, expand a length of one frame for a low speed drive to (n×P), where n is a positive integer equal to or greater than 2, assign a length P to each of n sub-frames included in the one frame for the low speed drive, group a plurality of display line pairs each including two adjacent display lines into n groups, and respectively drive the n display line pair groups in the n sub-frames in an interlaced low speed driving scheme by controlling an operation of the driver unit.

The driver unit includes a gate driver for driving gate lines of the display panel and a source driver for driving data lines of the display panel. In the interlaced low speed driving mode, the timing controller groups a plurality of gate line pairs each including two adjacent gate lines into n groups, respectively drives the n gate line pair groups in the n sub-frames in the interlaced low speed driving scheme by controlling an operation of the gate driver, completes a scanning operation of the gate lines belonging to the corresponding gate line pair group during a scan period occupying a portion of one sub-frame, generates a buffer operation control signal, and shuts off a driving power source applied to buffers of the source driver during a skip period corresponding to a remaining period excluding the scan period from the one sub-frame.

In the interlaced low speed driving mode, the timing controller changes a polarity control signal, expands a polarity inversion period of a data voltage, which will be input to the display panel, to one frame for the low speed drive, controls an operation of the source driver, outputs the data voltage to the data lines during the scan period, and skips an output of the data voltage during the skip period.

The source driver outputs the data voltages of opposite polarities through adjacent output channels in a column inversion scheme and inverts a polarity of each output channel in a cycle of one frame for the low speed drive in response to the polarity control signal.

The scan period occupies 1/n of each sub-frame, and the skip period following the scan period occupies (n−1)/n of each sub-frame.

The timing controller sets one gate time required to scan one gate line in each sub-frame to '1H' defined by the length P of one sub-frame/the number of gate lines and sets a distance between rising edges of adjacent scan pulses scanned in an interlaced scheme in one sub-frame to '1H', so as to secure the skip period in the interlaced low speed driving mode.

A scanning operation of the gate driver and a data voltage supply operation of the source driver are skipped during the skip period of each sub-frame.

BRIEF DESCRIPTION OF THE DRAWINGS

The accompanying drawings, which are included to provide a further understanding of the embodiments and are incorporated in and constitute a part of this specification, illustrate embodiments of the disclosure and together with the description serve to explain the principles of the disclosure. In the drawings.

DETAILED DESCRIPTION OF THE ILLUSTRATED EMBODIMENTS

Reference will now be made in detail to embodiments of the disclosure, examples of which are illustrated in the accompanying drawings. Wherever possible, the same reference numbers will be used throughout the drawings to refer to the same or like parts.

Exemplary embodiments of the disclosure will be described with reference to FIGS. 5 to 14C.

Figure 5:
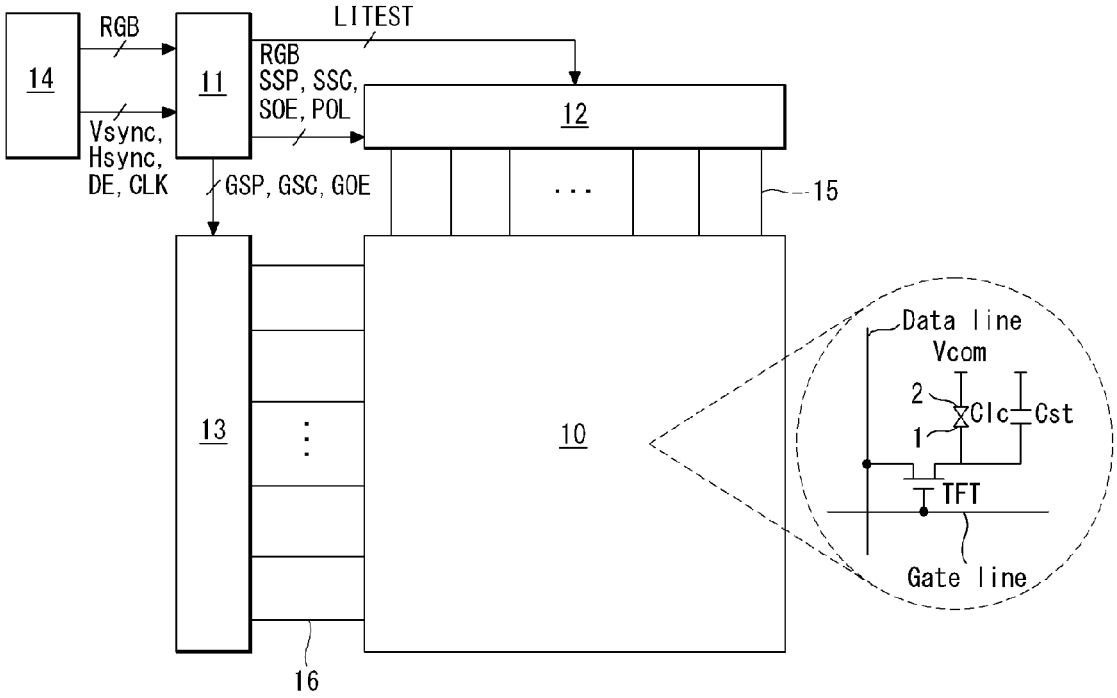
FIG. 5 is a block diagram of a display device according to one embodiment.

FIG. 5 is a block diagram of a display device capable of driving at low speed according to an exemplary embodiment of the invention.

As shown in FIG. 5, the display device capable of driving at low speed may be implemented as a flat panel display, such as a liquid crystal display (LCD), a field emission display (FED), a plasma display panel (PDP), an organic light emitting display, or an electrophoresis display (EPD). In the following description, the liquid crystal display is used as an example of the flat panel display. Other flat panel displays may alternatively be used.

The display device according to one embodiment includes a display panel 10, a timing controller 11, a source driver 12, a gate driver 13, and a host system 14. The source driver 12 and the gate driver 13 constitute a driver unit.

The display panel 10 includes a lower glass substrate, an upper glass substrate, and a liquid crystal layer formed between the lower glass substrate and the upper glass substrate.

A pixel array is formed on the lower glass substrate of the display panel 10. The pixel array includes liquid crystal cells (i.e., pixels) Clc formed at crossings of data lines 15 and gate lines 16, thin film transistors (TFTs) connected to pixel electrodes 1 of the pixels, common electrodes 2 opposite the pixel electrodes 1, and storage capacitors Cst. Each liquid crystal cell Clc is connected to the TFT and is driven by an electric field between the pixel electrode 1 and the common electrode 2. Black matrixes, red, green, and blue color filters, etc. are formed on the upper glass substrate of the display panel 10. Polarizing plates are respectively attached to the upper and lower glass substrates of the display panel 10. Alignment layers for setting a pre-tilt angle of liquid crystals are respectively formed on the upper and lower glass substrates of the display panel 10.

The common electrodes 2 are formed on the upper glass substrate in a vertical electric field driving manner such as a twisted nematic (TN) mode and a vertical alignment (VA) mode. The common electrodes 2 are formed on the lower glass substrate along with the pixel electrodes 1 in a horizontal electric field driving manner such as an in-plane switching (IPS) mode and a fringe field switching (FFS) mode.

The display panel 10 applicable to the embodiment of the disclosure may be implemented in any liquid crystal mode including the TN mode, the VA mode, the IPS mode, the FFS mode, etc. The liquid crystal display according to the embodiment of the invention may be implemented as any type liquid crystal display including a transmissive liquid crystal display, a transflective liquid crystal display, and a reflective liquid crystal display. The transmissive liquid crystal display and the transflective liquid crystal display require a backlight unit. The backlight unit may be implemented as a direct type backlight unit or an edge type backlight unit.

Figure 1:
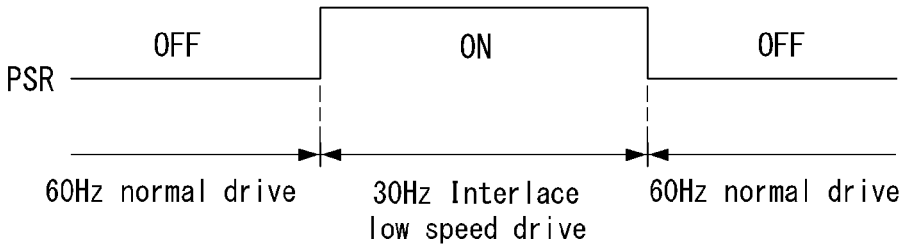
FIG. 1 (RELATED ART)
FIG. 1 illustrates an operation of a related art display device selecting a normal driving mode and an interlaced low speed driving mode in response to a panel self refresh (PSR) control signal.
Figure 2:
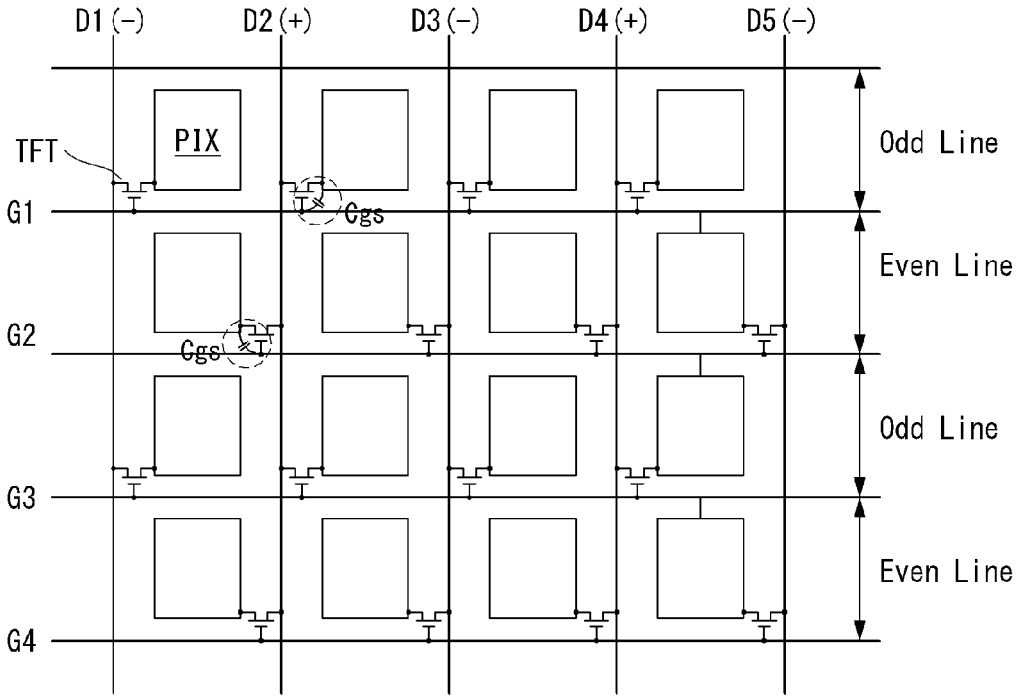
FIG. 2 (RELATED ART)
FIG. 2 illustrates a connection structure of pixels applied to a related art display device capable of driving at low speed.
Figure 3A:
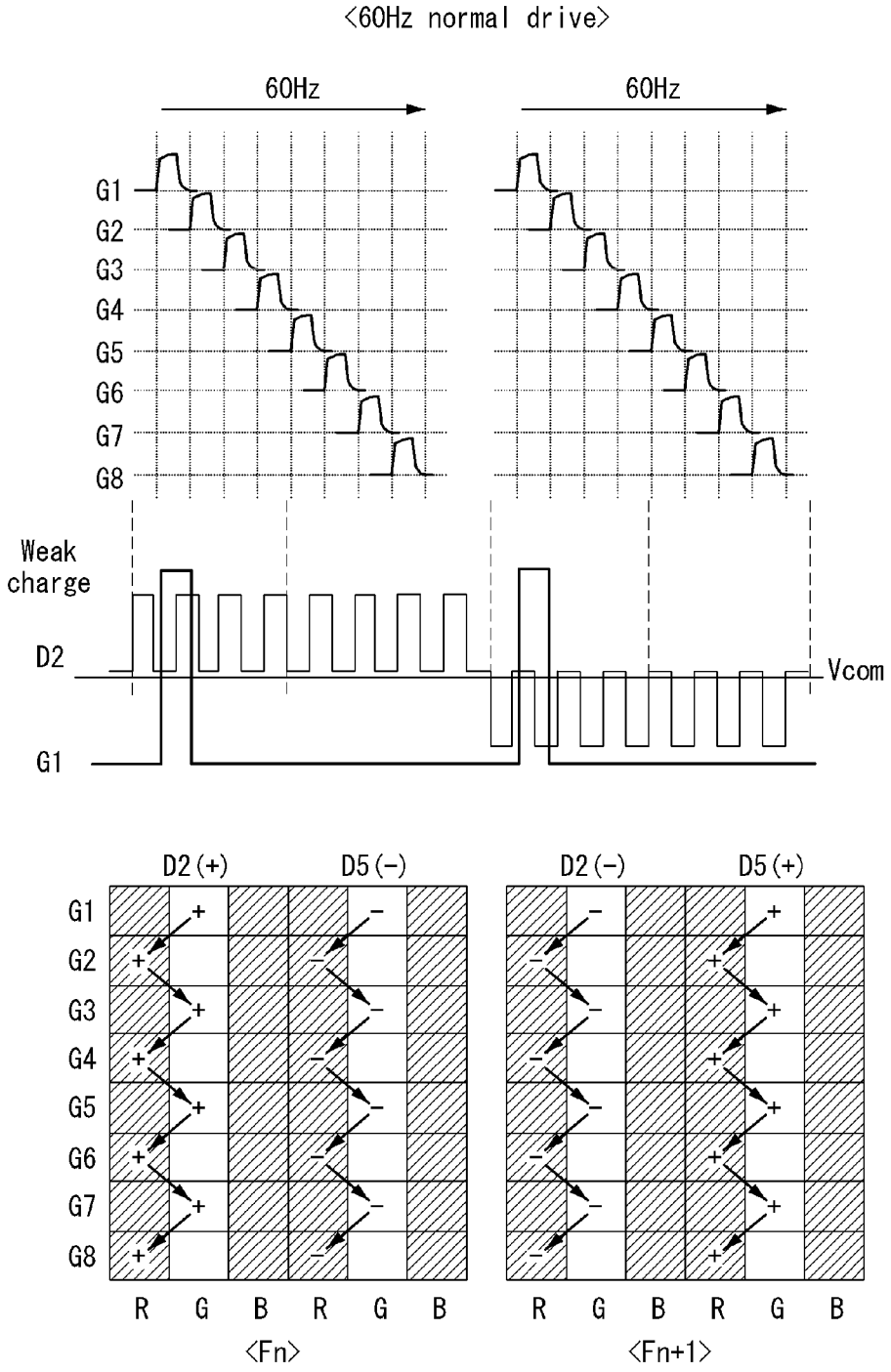
FIG. 3A (RELATED ART)
FIG. 3A illustrates the transition of data supplied through one data line during 60 Hz normal drive.
Figure 3B:
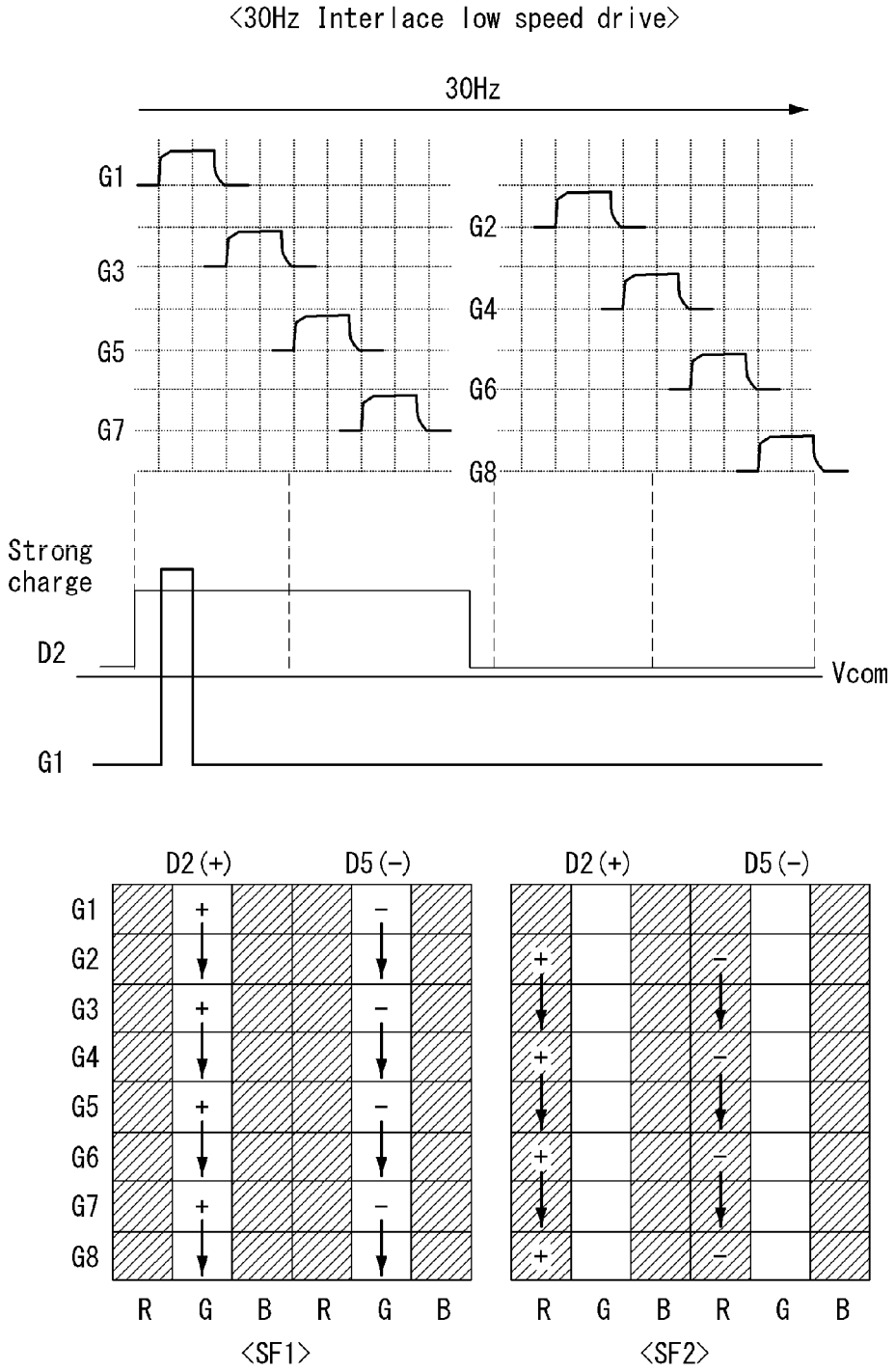
FIG. 3B (RELATED ART)
FIG. 3B illustrates the transition of data supplied through one data line during 30 Hz interlaced low speed drive.
Figure 4:
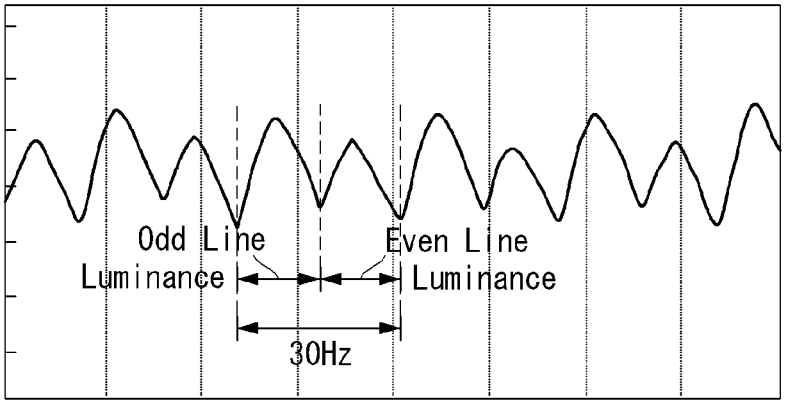
FIG. 4 (RELATED ART)
FIG. 4 shows 30 Hz flicker as an example of a flicker generated in a related art display device during an interlaced low speed drive.

The display device according to the embodiment of the disclosure may design a connection structure of the pixels in a Z-inversion scheme (as shown in FIG. 2) and may control polarities of data voltages output from the source driver 12 in a column inversion scheme, as a method for reducing power consumption. Referring to FIG. 2, in the pixel connection structure of the Z-inversion scheme, each of the pixels on odd-numbered display lines may be connected to the data line through the TFT and may be disposed on the right side of the data line, and each of the pixels on even-numbered display lines may be connected to the data line through the TFT and may be disposed on the left side of the data line. The source driver 12 increases a polarity inversion period of the data voltage output through one output channel to one frame using the column inversion scheme. Thus, the pixels, which are disposed in a zigzag shape based on the same data line (for example, D2) in a vertical direction, receive the data voltage of the same polarity. The display device may reduce the power consumption while controlling a display polarity in a dot inversion scheme based on the pixel connection structure and a polarity control method of the data voltage.

Referring back to FIG. 5, the timing controller 11 receives digital video data RGB of an input image from the host system 14 through a low voltage differential signaling (LVDS) interface and supplies the digital video data RGB of the input image to the source driver 12 through a mini LVDS interface. The timing controller 11 arranges the digital video data RGB received from the host system 14 in conformity with disposition configuration of the pixel array and then supplies the arranged digital video data RGB to the source driver 12.

The timing controller 11 receives timing signals, such as a vertical sync signal Vsync, a horizontal sync signal Hsync, a data enable signal DE, and a dot clock CLK, from the host system 14 and generates control signals for controlling operation timings of the source driver 12 and the gate driver 13. The control signals include a gate timing control signal for controlling operation timing of the gate driver 13 and a source timing control signal for controlling operation timing of the source driver 12.

The gate timing control signal includes a gate start pulse GSP, a gate shift clock GSC, a gate output enable signal GOE, etc. The gate start pulse GSP is applied to a gate driver integrated circuit (IC) generating a first scan pulse and controls the gate driver IC so that the first scan pulse is generated. The gate shift clock GSC is commonly input to gate driver ICs of the gate driver 13 and shifts the gate start pulse GSP. The gate output enable signal GOE controls an output of the gate driver ICs.

The source timing control signal includes a source start pulse SSP, a source sampling clock SSC, a polarity control signal POL, a source output enable signal SOE, etc. The source start pulse SSP controls data sampling start timing of the source driver 12. The source sampling clock SSC controls sampling timing of data in the source driver 12 based on its rising or falling edge. The polarity control signal POL controls polarities of the data voltages sequentially output from each output channel of the source driver 12. The source output enable signal SOE controls output timing of the source driver 12.

The timing controller 11 receives a mode conversion control signal from the host system 14 and changes a frame frequency for controlling an operation of the driver units 12 and 13 including the source driver 12 and the gate driver 13 in response to the mode conversion control signal, thereby making it possible to drive the display panel 10 in a normal driving mode or an interlaced low speed driving mode. A panel self refresh (PSR) control signal may be selected as the mode conversion control signal. The host system 14 includes various known image decision means and thus may decide whether the input image is a stop image or a moving image. The host system 14 may generate the PSR control signal at an on-level when the stop image is input, and may generate the PSR control signal at an off-level when the moving image is input.

The timing controller 11 controls the operation of the driver units 12 and 13 in conformity with the normal driving mode, in which the frame frequency is a reference value, in response to the PSR control signal of the off-level. The embodiment of the disclosure is described using 60 Hz as an example of the reference value for the sake of brevity and ease of reading, but is not limited thereto. The reference value may vary depending on a model and a resolution of the display panel, etc. Other values may be used for the reference value. In the normal driving mode, the source timing control signal and the gate timing control signal are generated based on the frame frequency of 60 Hz.

The timing controller 11 controls the operation of the driver units 12 and 13 in conformity with the interlaced low speed driving mode, in which the frame frequency is less (or slower) than 60 Hz, in response to the PSR control signal of the on-level. In the interlaced low speed driving mode, the source timing control signal and the gate timing control signal are generated based on the frame frequency of 60/n Hz, where n is a positive integer equal to or greater than 2.

The timing controller 11 implements the interlaced low speed driving mode through a scan drive and a skip drive, so as to efficiently reduce the power consumption. Further, the timing controller 11 implements the interlaced low speed driving mode through 2-line interlaced drive, so as to reduce a luminance deviation when the driving mode is converted, and also so as to minimize the generation of a flicker during the interlaced low speed drive. The 2-line interlaced drive is a driving method, which groups a plurality of display line pairs each including two adjacent display lines into n groups and controls the operation of the driver unit 12(13) to thereby respectively drive the n display line pair groups in n sub-frames in an interlaced low speed driving scheme. An operation and an operation effect of the timing controller 11 are described in detail below.

The source driver 12 includes a shift register, a latch array, a digital-to-analog converter, an output circuit, and the like. The source driver 12 latches the digital video data RGB in response to the source timing control signal and converts the latched digital video data RGB into positive and negative analog gamma compensation voltages. The source driver 12 then supplies the data voltages, of which polarities are inverted every a predetermined period of time, to the data lines 15 through a plurality of output channels. The output circuit includes a plurality of buffers. The buffers are connected to the output channels of the source driver 12, and the output channels are respectively connected to the data lines 15. The source driver 12 changes the polarity of the data voltage output from each output channel through the column inversion scheme in response to the polarity control signal POL received from the timing controller 11. According to the column inversion scheme, the polarity of the data voltage output through the same output channel is inverted in a cycle of one frame period. Polarities of the data voltages output through the adjacent output channels in the same frame period are opposite to each other.

The gate driver 13 supplies the scan pulse to the gate lines 16 in response to the gate timing control signal using a shift register and a level shifter. The gate driver 13 supplies the scan pulse to the gate lines 16 in a line sequential manner in the normal driving mode and supplies the scan pulse to the gate lines 16 in an interlaced scheme in the interlaced low speed driving mode. The shift register of the gate driver 13 may be directly formed on the lower glass substrate of the display panel 10 through a gate driver-in-panel (GIP) process.

Figure 6:
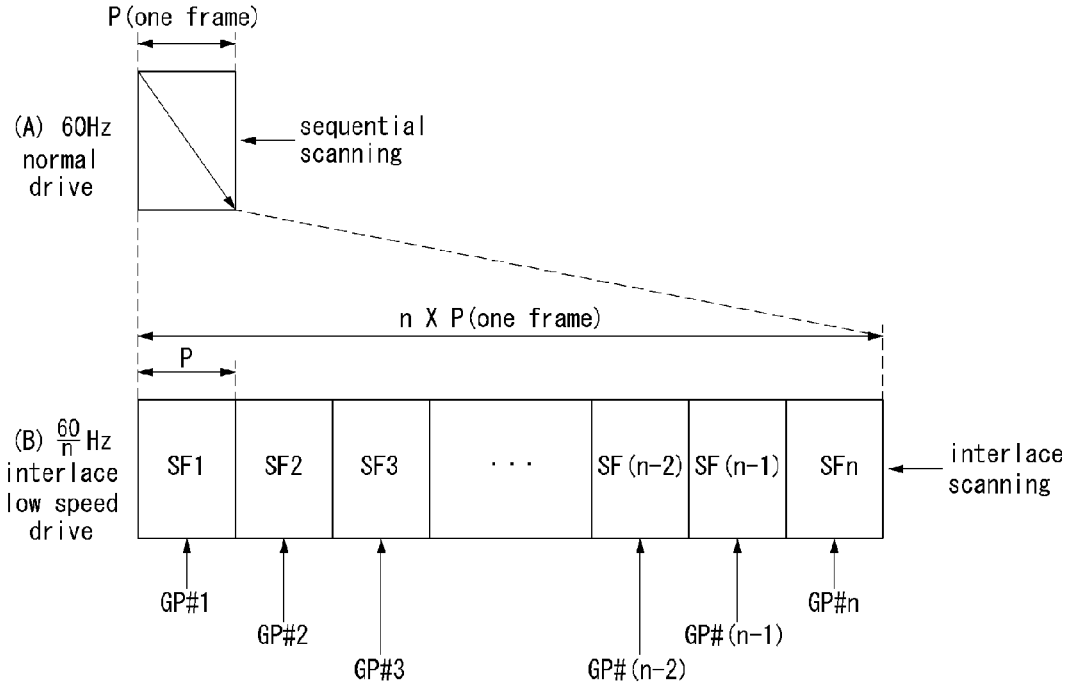
FIGS. 6 and 7 illustrate an operation of a timing controller for an interlaced low speed drive according to one embodiment.
Figure 7:
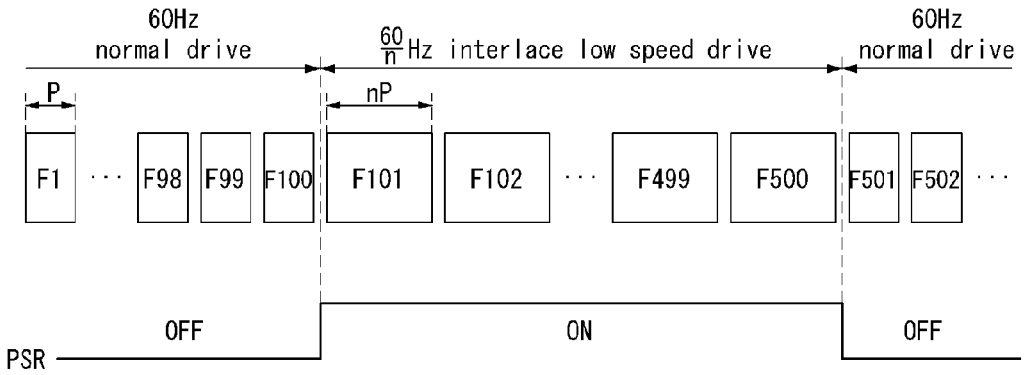
Figure 8:
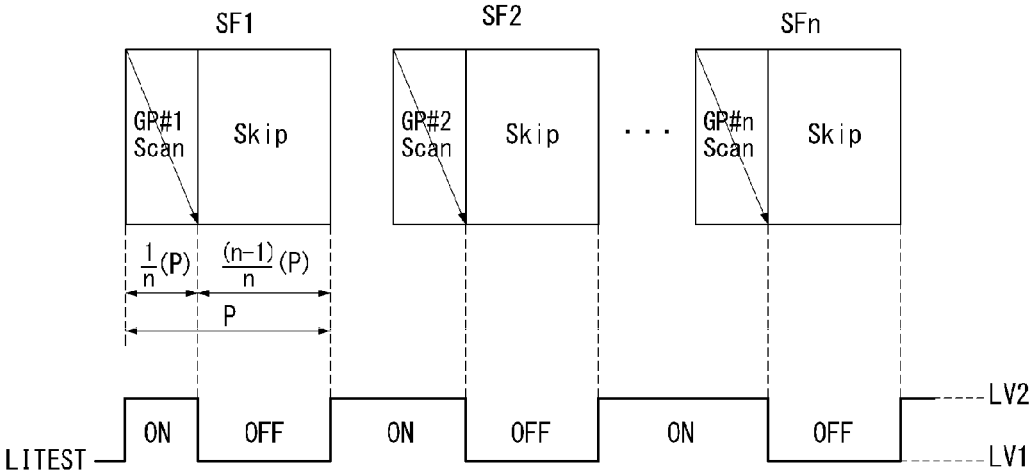
FIG. 8 illustrates a principle of an interlaced low speed drive, implemented through a scan drive and a skip drive, according to one embodiment.

FIGS. 6 and 7 illustrate an operation of the timing controller for an interlaced low speed drive according to one embodiment of the disclosure. FIG. 8 illustrates a principle of the interlaced low speed drive according to the embodiment of the invention implemented by a scan drive and a skip drive.

As shown in FIG. 6, when the PSR control signal of the on-level is input during the normal drive, in which a length of one frame is set to P (e.g., 1/60 second), the timing controller 11 expands a length of one frame for the low speed drive to (n×P), where n is a positive integer equal to or greater than 2. The timing controller 11 assigns a length corresponding to 'P' to each of n sub-frames included in the one frame for the low speed drive and then controls the operation of the driver units 12 and 13 in the interlaced low speed driving scheme.

Figure 9:
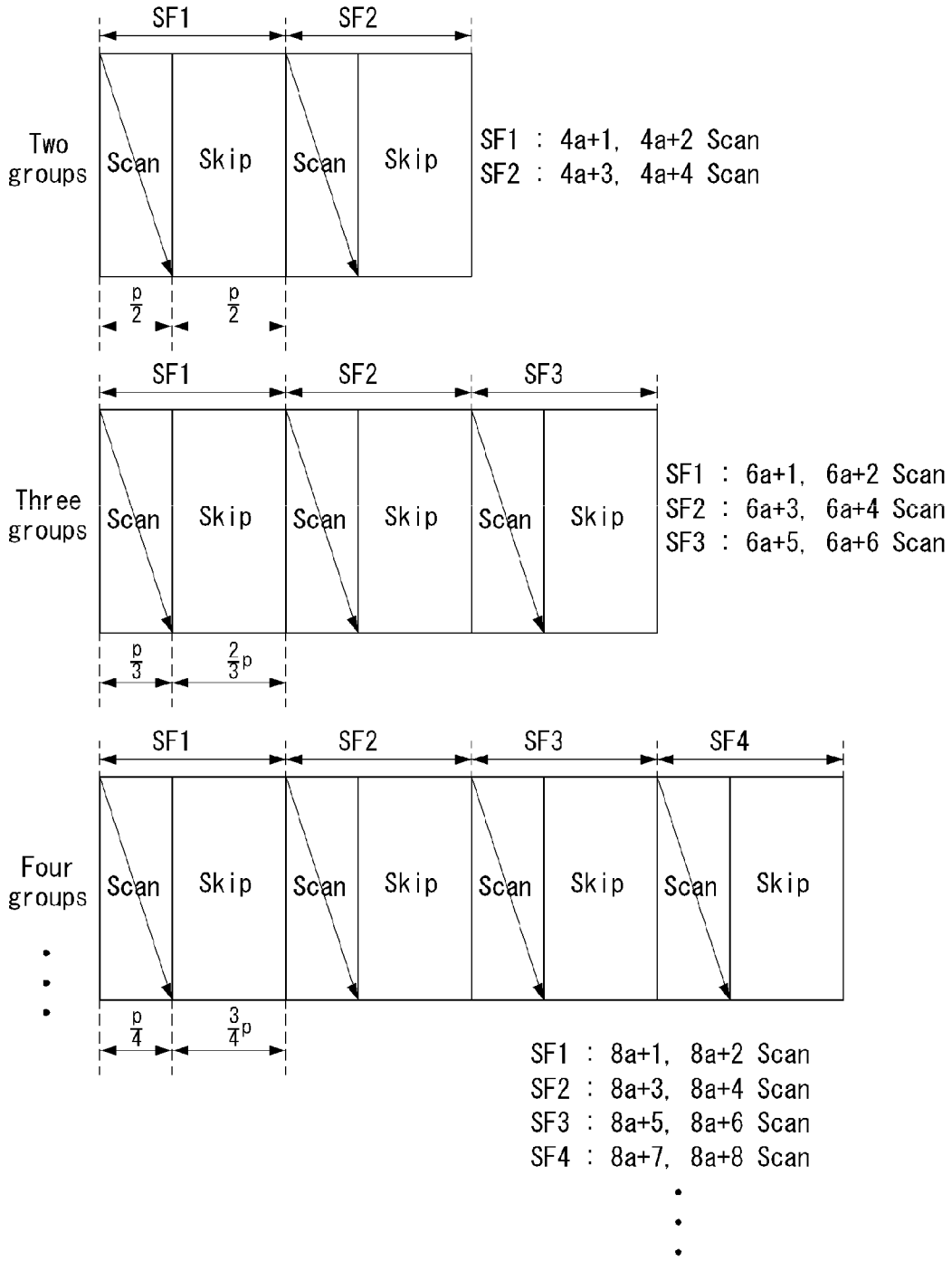
FIG. 9 shows various scanning methods capable of reducing a luminance deviation in the conversion of a driving mode and minimizing the generation of a flicker in an interlaced low speed drive, according to one embodiment.

In particular, the timing controller 11 groups a plurality of display line pairs (each of which includes adjacent odd-numbered and even-numbered display lines as shown in FIG. 2) each including two adjacent display lines into n groups and respectively drives the n display line pair groups, respectively, in n sub-frames SF1 to SFn in the interlaced low speed driving scheme, by controlling the operation of the driver units 12 and 13, so as to implement the 2-line interlaced drive. For this, the timing controller 11 groups a plurality of gate line pairs each including two adjacent gate lines 16 into n gate line pair groups GP#1 to GP#n. Further, as shown in FIG. 6, the timing controller 11 causes the n gate line pair groups GP#1 to GP#n to respectively correspond to the n sub-frames SF1 to SFn according to the driving order, thereby implementing the interlaced drive. In the embodiments disclosed herein, the number of gate line pair groups is set to be equal to the number of sub-frames configuring one frame for the low speed drive. For example, as shown in FIG. 9, when two sub-frames constitute one frame for the low speed drive, the gate line pair groups may include a first gate line pair group GP#1 (corresponding to sub-frame SF1) including (4a+1)th gate lines and (4a+2)th gate lines, where 'a' is a positive integer including zero; and a second gate line pair group GP#2 (corresponding to sub-frame SF2) including (4a+3)th gate lines and (4a+4)th gate lines. In each sub-frame, the gate lines belonging to one gate line pair group are sequentially driven.

Referring now to FIG. 8, to efficiently reduce the power consumption during the interlaced low speed drive, the timing controller 11 controls the operation of the gate driver 13 in each sub-frame and completes the sequential scan of the gate lines belonging to the corresponding gate line pair group during 1/n period (hereinafter referred to as a scan period P/n, as illustrated in FIG. 8) of the one sub-frame. Further, the timing controller 11 generates a buffer operation control signal LITEST and shuts off a driving power source (for example, a high potential driving voltage and a ground level voltage) applied to the buffers of the source driver 12 during a remaining period (n−1)/n (hereinafter referred to as a skip period P(n−1)/n) excluding the scan period P/n from the one sub-frame.

Returning to FIG. 6, for the interlaced low speed drive, the timing controller 11 changes the polarity control signal POL and expands a polarity inversion period of the data voltage, which will be input to the display panel 10, to one frame period (n×P) for the low speed drive. Further, the timing controller 11 outputs the data voltage to the data lines 15 during the scan period P/n (shown in FIG. 8) and then skips the output of the data voltage during the skip period P(n−1)/n (also illustrated in FIG. 8) through the control of the operation of the source driver 12.

In other words, as shown in FIG. 8, the timing controller 11 controls the operation of the gate driver 13 during the scan period P/n of the first sub-frame SF1 (of length P) and sequentially scans the gate lines 16 belonging to the first gate line pair group GP#1. Further, the timing controller 11 controls the operation of the source driver 12 and supplies the data voltage synchronized with the scan of the first gate line pair group GP#1 to the data lines 15. As shown in FIG. 8, in the same manner as the first sub-frame SF1, the timing controller 11 controls the operation of the gate driver 13 during the scan period P/n of the nth sub-frame SFn (of length P) and sequentially scans the gate lines 16 belonging to the nth gate line pair group GP#n. Further, the timing controller 11 controls the operation of the source driver 12 and supplies the data voltage synchronized with the scan of the nth gate line pair group GP#n to the data lines 15.

As shown in FIG. 8, the timing controller 11 skips the scan operation of the gate driver 13 and the data voltage supply operation of the source driver 12 during the skip period P(n−1)/n except the scan period P/n (assigned to the scan operation) from each of the first to nth sub-frames SF1 to SFn each having the length P.

Figure 11:
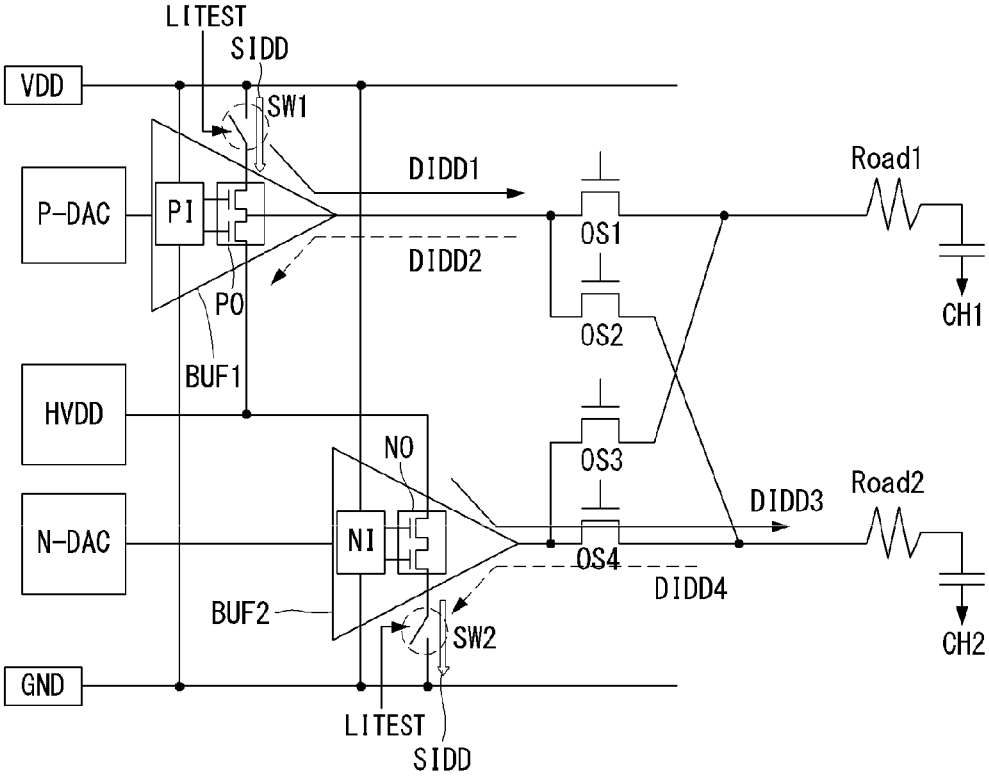
FIG. 11 illustrates configuration of switches for removing a static current flowing in buffers of a source driver.

As shown in FIG. 8, the timing controller 11 generates the buffer operation control signal LITEST at an on-level LV2 during the scan period P/n of each of the n sub-frames SF1 to SFn and generates the buffer operation control signal LITEST at an off-level LV1 during the skip period P(n−1)/n of each of the n sub-frames SF1 to SFn, thereby controlling switching operations of the first and second switches SW1 and SW2 of the source driver 12 (shown in and explained further with reference to FIG. 11). The driving power source (for example, the high potential driving voltage and the ground level voltage) applied to the buffers of the source driver 12 is not shut off when the buffer operation control signal LITEST is generated at the on-level LV2, but is shut off when the buffer operation control signal LITEST is generated at the off-level LV1. The timing controller 11 controls the operation of the source driver 12, so that the drive of the source driver 12 is skipped during the skip period P(n−1)/n of each of the n sub-frames SF1 to SFn. Further, the timing controller 11 shuts off the driving power source applied to the source driver 12 and removes a static current flowing in the buffers of the source driver 12. Hence, power consumption of the source driver 12 is greatly reduced.

FIG. 7 shows an input level of the PSR control signal when $101^{th}$ to $500^{th}$ frames (F101 to F500) operate in the interlaced low speed driving mode and the remaining frames operate in the normal driving mode. In some embodiments, a polarity inversion period of the data voltage output by the source driver 12 is one frame period P for the normal drive in the normal driving mode (e.g., when PSR control signal is OFF) and is expanded to one frame period (n×P) for the low speed drive in the interlaced low speed driving mode (e.g., when PSR control signal is ON).

Figure 10:
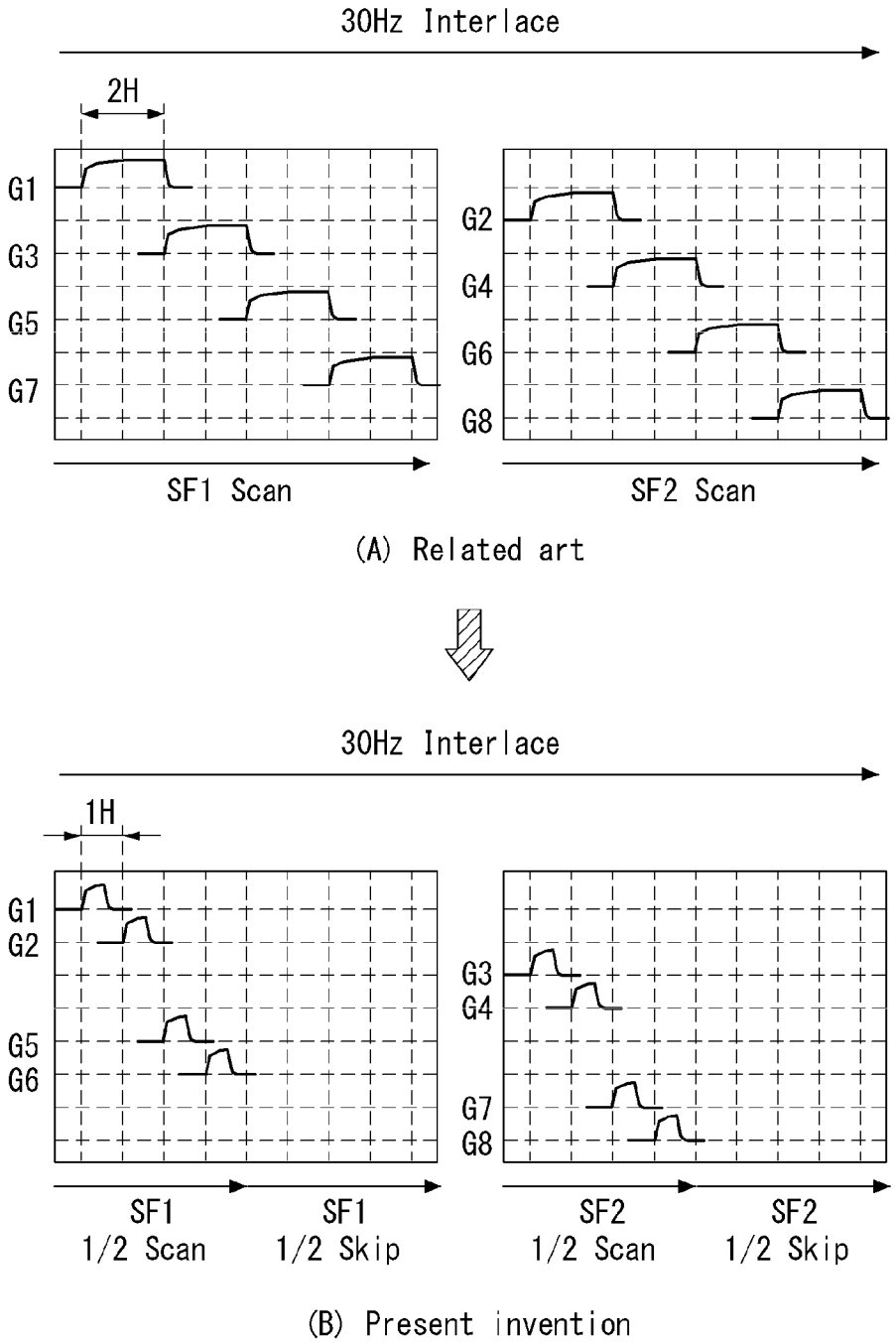
FIG. 10 shows an example of setting one gate time so that a scan drive, a skip drive, and an interlaced low speed drive of gate line pairs can be performed.

FIG. 9 shows various scanning methods for reducing the luminance deviation in the conversion of the driving mode and minimizing the generation of the flicker in the interlaced low speed drive. FIG. 10 shows an example of setting one gate time so that the scan drive, the skip drive, and the 2-line interlaced low speed drive can be performed.

As shown in FIG. 9, the timing controller 11 may group a plurality of gate line pairs each including two adjacent gate lines 16 into two gate line pair groups GP#1 and GP#2. In this instance, the gate lines belonging to the first gate line pair group GP#1 (corresponding to sub-frame SF1) include (4a+1)th gate lines and (4a+2)th gate lines, where 'a' is a positive integer including zero, and the gate lines belonging to the second gate line pair group GP#2 (corresponding to sub-frame SF2) include (4a+3)th gate lines and (4a+4)th gate lines. The timing controller 11 sequentially scans the gate lines belonging to the first gate line pair group GP#1 during a scan period p/2 of a first sub-frame SF1, and then sequentially scans the gate lines belonging to the second gate line pair group GP#2 during a scan period p/2 of a second sub-frame SF2.

As shown in FIG. 9, the timing controller 11 may group a plurality of gate line pairs each including a pair of adjacent gate lines 16 into three gate line pair groups GP#1 to GP#3 (corresponding to sub-frames SF1 to SF3). In this instance, the gate lines belonging to the first gate line pair group GP#1 include (6a+1)th gate lines and (6a+2)th gate lines, the gate lines belonging to the second gate line pair group GP#2 include (6a+3)th gate lines and (6a+4)th gate lines, and the gate lines belonging to the third gate line pair group GP#3 include (6a+5)th gate lines and (6a+6)th gate lines. The timing controller 11 sequentially scans the gate lines belonging to the first gate line pair group GP#1 during a scan period p/3 of a first sub-frame SF1, and then sequentially scans the gate lines belonging to the second gate line pair group GP#2 during a scan period p/3 of a second sub-frame SF2. Further, the timing controller 11 sequentially scans the gate lines belonging to the third gate line pair group GP#3 during a scan period p/3 of a third sub-frame SF3.

As shown in FIG. 9, the timing controller 11 may group a plurality of gate line pairs each including two adjacent gate lines 16 into four gate line pair groups GP#1 to GP#4 (corresponding to sub-frames SF1 to SF4). In this instance, the gate lines belonging to the first gate line pair group GP#1 include (8a+1)th gate lines and (8a+2)th gate lines, the gate lines belonging to the second gate line pair group GP#2 include (8a+3)th gate lines and (8a+4)th gate lines, the gate lines belonging to the third gate line pair group GP#3 include (8a+5)th gate lines and (8a+6)th gate lines, and the gate lines belonging to the fourth gate line pair group GP#4 include (8a+7)th gate lines and (8a+8)th gate lines. The timing controller 11 sequentially scans the gate lines belonging to the first gate line pair group GP#1 during a scan period p/4 of a first sub-frame SF1, and then sequentially scans the gate lines belonging to the second gate line pair group GP#2 during a scan period p/4 of a second sub-frame SF2. Afterwards, the timing controller 11 sequentially scans the gate lines belonging to the third gate line pair group GP#3 during a scan period p/4 of a third sub-frame SF3, and then sequentially scans the gate lines belonging to the fourth gate line pair group GP#4 during a scan period p/4 of a fourth sub-frame SF4.

As shown in FIG. 10, the timing controller 11 sets one gate time required to scan one gate line in each of the sub-frames SF1 to SFn to '1H' defined by a length P of one sub-frame/the number of gate lines and also sets a distance between rising edges of the adjacent scan pulses scanned in the interlaced scheme in one sub-frame to '1H', so as to secure the skip period P(n−1)/n in the interlaced low speed drive.

In other words, in the related art, one gate time (indicating a charge time of pixels disposed on one display line) required to scan one gate line in 60/n Hz interlaced low speed drive is n times longer than one gate time '1H' (herein, defined by the length P of one sub-frame/the number of gate lines) in the 60 Hz normal drive. On the other hand, in the embodiments of the disclosure, one gate time in the 60/n Hz interlaced low speed drive is set to the same value '1H' as the normal drive. For example, as shown in FIG. 8, in 30 Hz interlaced low speed drive, in which one frame is time-divided into two sub-frames SF1 and SF2, one gate time was set to 2H in the related art, but one gate time is set to 1H in the embodiment of the disclosure. Further, a rising time of each scan pulse in the embodiment of the invention is earlier than the related art by 1H. Hence, the embodiment of the disclosure can perform a high speed scanning operation (indicating the sequential scanning operation of all of the gate lines assigned to a sub-frame using only a portion of the sub-frame) in each sub-frame.

Figure 12:
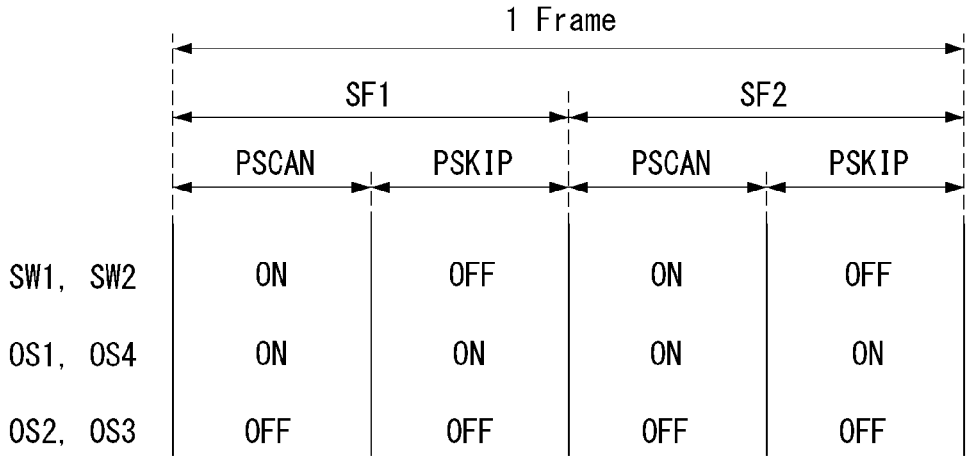
FIG. 12 illustrates a switching operation of switches shown in FIG. 11 in scan periods and skip periods of first and second sub-frames during 30 Hz interlaced low speed drive.

FIG. 11 illustrates configuration of switches for removing a static current flowing in the buffers of the source driver (e.g., source driver 12 of FIG. 5). FIG. 12 illustrates a switching operation of switches shown in FIG. 11 in scan periods and skip periods of first and second sub-frames in the 30 Hz interlaced low speed drive.

As shown in FIG. 11, the source driver 12 includes a first digital-to-analog converter P-DAC for converting the input digital video data into a positive gamma compensation voltage, a first buffer BUF1 for buffering and outputting the positive gamma compensation voltage, a second digital-to-analog converter N-DAC for converting the input digital video data into a negative gamma compensation voltage, and a second buffer BUF2 for buffering and outputting the negative gamma compensation voltage.

A high potential driving voltage VDD, a ground level voltage GND, and a driving voltage HVDD (hereinafter referred to as "middle potential driving voltage") and having a middle potential of the voltages VDD and GND are applied to the first buffer BUF1 and the second buffer BUF2. A voltage level of the middle potential driving voltage HVDD may correspond to about one half of the high potential driving voltage VDD and may be substantially equal to a common voltage Vcom applied to the display panel 10 (shown in FIG. 5).

The first buffer BUF1 includes a first input unit PI operating by the high potential driving voltage VDD and the ground level voltage GND and a first output unit PO operated by the high potential driving voltage VDD and the middle potential driving voltage HVDD. The second buffer BUF2 includes a second input unit NI operated by the high potential driving voltage VDD and the ground level voltage GND and a second output unit NO operated by the high potential driving voltage VDD and the middle potential driving voltage HVDD.

A first dynamic current DIDD1 is discharged from the first output unit PO, or a second dynamic current DIDD2 enters the first output unit PO through a switching operation of the first output unit PO. Further, a third dynamic current DIDD3 is discharged from the second output unit NO, or a fourth dynamic current DIDD4 enters the second output unit NO through a switching operation of the second output unit NO. In the embodiment disclosed herein, when a high gray level image is implemented, the first and third dynamic currents DIDD1 and DIDD3 enter the data lines through output channels CH1 and CH2. Further, when a low gray level image is implemented, the second and fourth dynamic currents DIDD2 and DIDD4 flow from the data lines via the output channels CH1 and CH2.

The source driver 12 may further include first to fourth polarity inversion switches OS1, OS2, OS3, and OS4. On-time of the first and fourth polarity inversion switches OS1 and OS4 and on-time of the second and third polarity inversion switches OS2 and OS3 may alternate with each other in a cycle of one frame for the low speed drive. When the first and fourth polarity inversion switches OS1 and OS4 are turned on in odd-numbered frames for the low speed drive, the second and third polarity inversion switches OS2 and OS3 may be turned on in even-numbered frames for the low speed drive. The embodiment of the disclosure may reduce the number of first digital-to-analog converters P-DAC and the number of second digital-to-analog converters N-DAC to one half through an alternate operation of the polarity inversion switches OS1, OS2, OS3, and OS4.

The related art source driver has a structure, in which a static current SIDD frequently flows between an input terminal of the high potential driving voltage VDD and the first buffer BUF1 and between the second buffer BUF2 and an input terminal of the ground level voltage GND. Because the related art has the structure in which the static current is typically generated irrespective of a reduction in a data transition frequency according to the low speed drive, the related art has a limitation of a sharp reduction in power consumption of the source driver.

Referring back to FIG. 11, the embodiment of the disclosure includes a first power switch SW1 connected between the input terminal of the high potential driving voltage VDD and the first output unit PO and a second power switch SW2 connected between the input terminal of the ground level voltage GND and the second output unit NO, so as to completely shut off the static current SIDD in the skip period of each sub-frame.

The first and second power switches SW1 and SW2 are turned on or off in response to the buffer operation control signal LITEST input (described above with reference to FIG. 8) from the timing controller 11 (described above with reference to FIG. 5). As shown in FIG. 12, the first and second power switches SW1 and SW2 are turned on in response to the buffer operation control signal LITEST of the on-level LV2 during a scan period PSCAN of each sub-frame and are turned off in response to the buffer operation control signal LITEST of the off-level LV1 during a skip period PSKIP of each sub-frame. When the first and second power switches SW1 and SW2 are turned off during the skip period PSKIP of each sub-frame, a current path, through which the static current can flow, is interrupted or broken. Thus, the static current flowing between the input terminal of the high potential driving voltage VDD and the first buffer BUF1 and the static current flowing between the second buffer BUF2 and the input terminal of the ground level voltage GND are completely blocked in the skip period PSKIP of each sub-frame.

Figure 13:
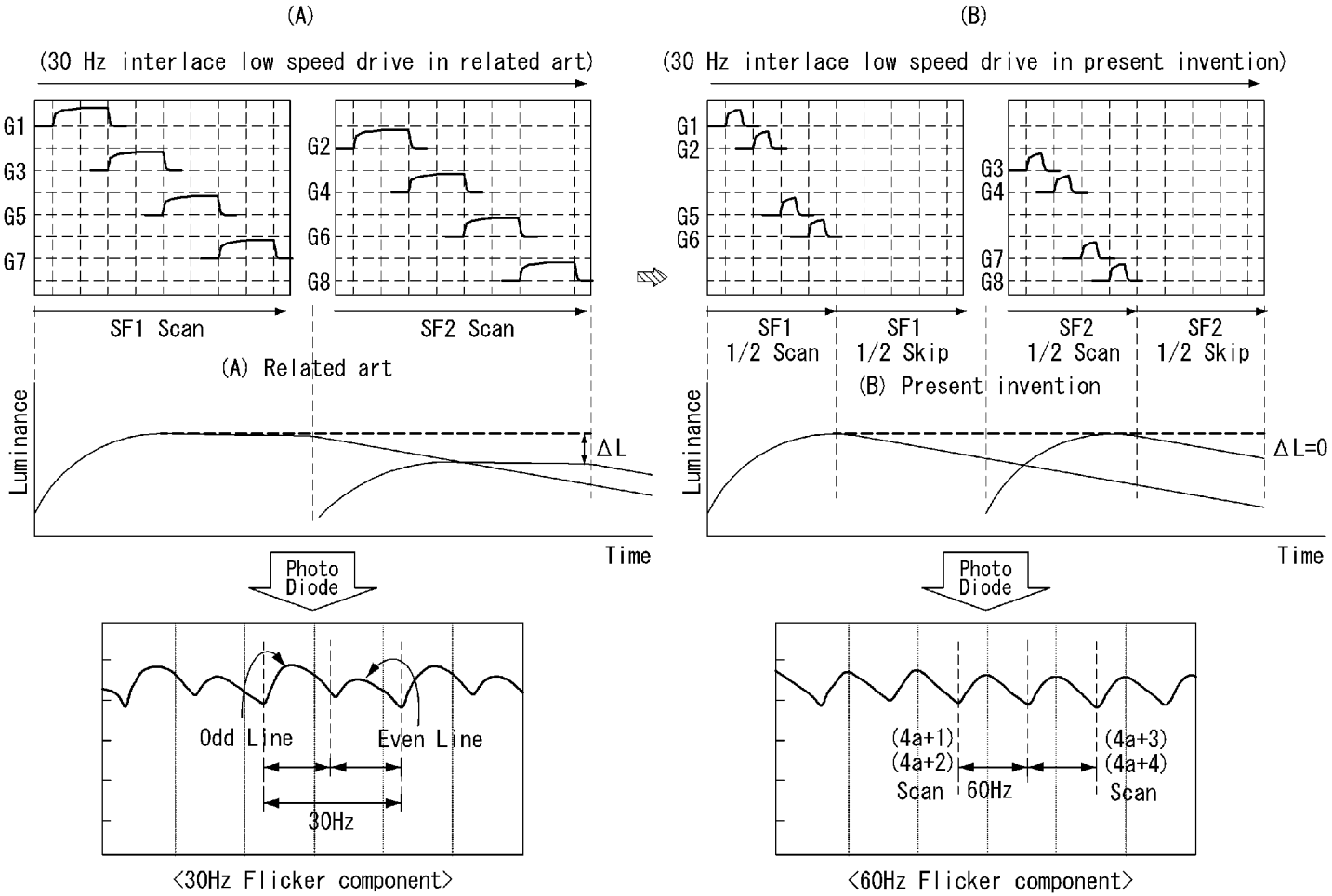
FIG. 13 shows that an embodiment of the disclosure prevents the generation of 30 Hz flicker during 30 Hz interlaced low speed drive, as compared with 30 Hz interlaced low speed drive in a related art.
Figure 14A:
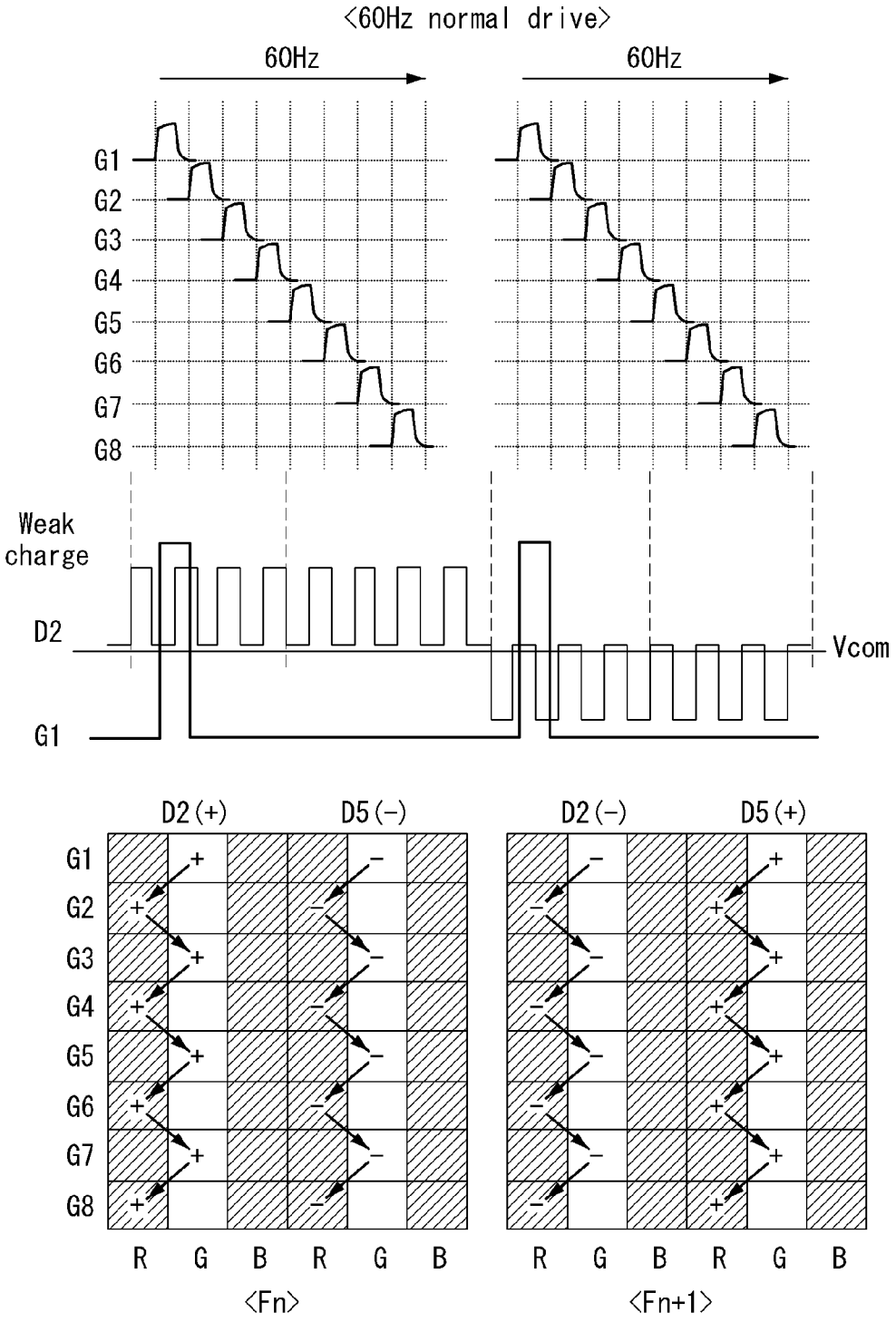
FIG. 14A illustrates the transition of data supplied through one data line during 60 Hz normal drive in one embodiment.
Figure 14B:
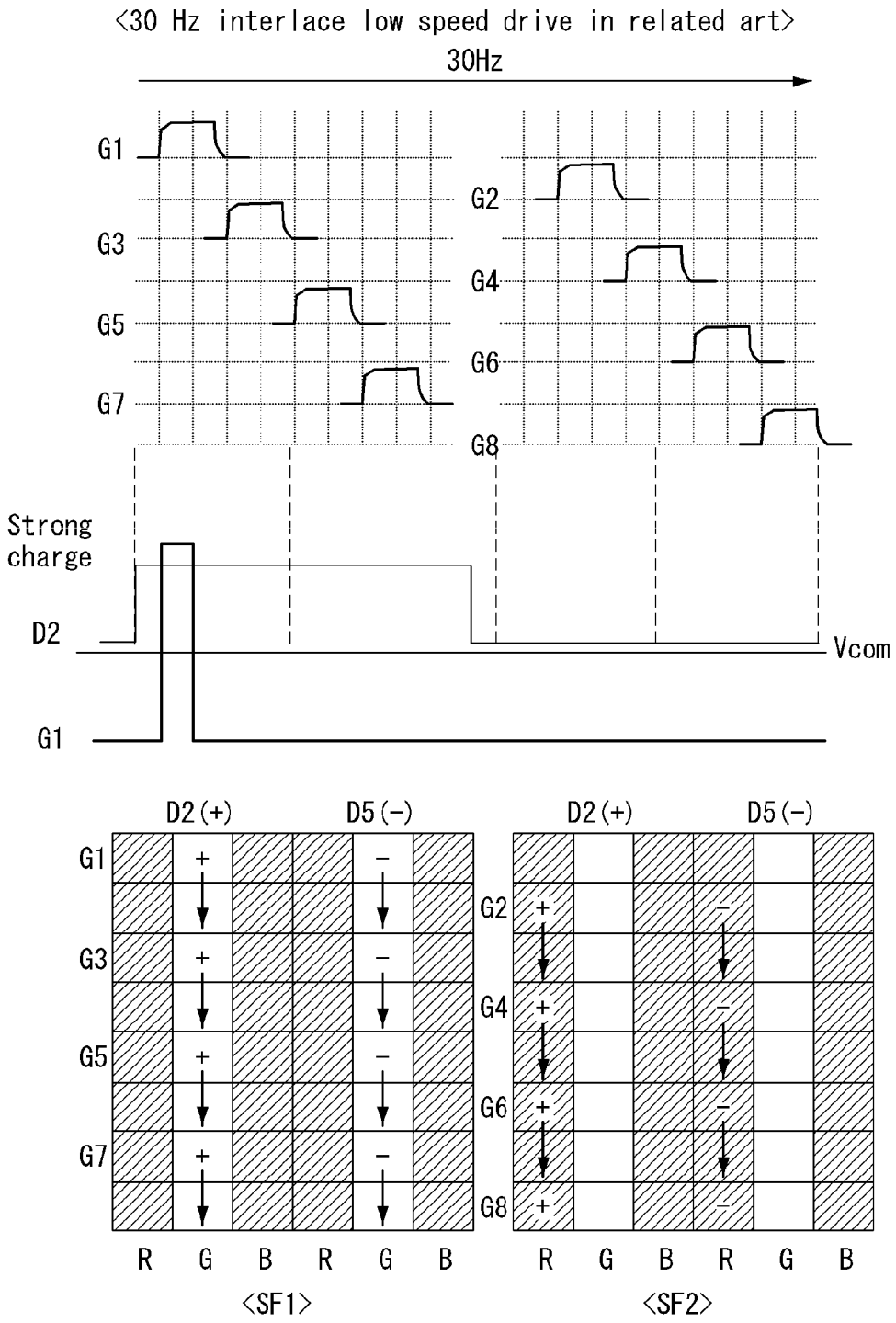
FIG. 14B illustrates the transition of data supplied through one data line during 30 Hz interlaced low speed drive in a related art.
Figure 14C:
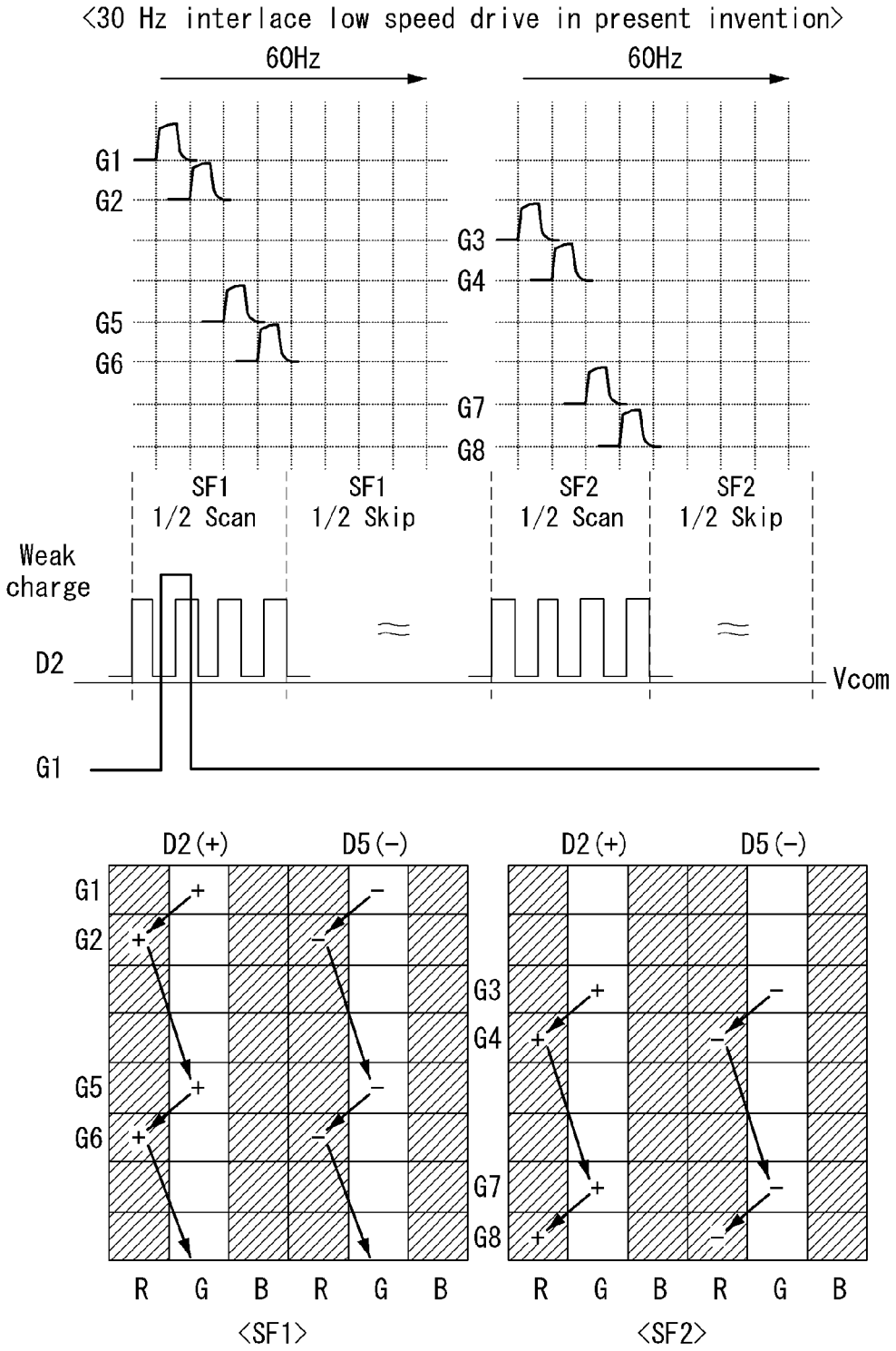
FIG. 14C illustrates the transition of data supplied through one data line during 30 Hz interlaced low speed drive in an embodiment of the invention.

FIG. 13 shows that these embodiments prevent the generation of 30 Hz flicker during the 30 Hz interlaced low speed drive, as compared with the 30 Hz interlaced low speed drive in the related art. FIG. 14A illustrates the transition of data supplied through one data line during the 60 Hz normal drive in the embodiment of the disclosure. FIG. 14B illustrates the transition of data supplied through one data line during the 30 Hz interlaced low speed drive in the related art. FIG. 14C illustrates the transition of data supplied through one data line during the 30 Hz interlaced low speed drive in the embodiment of the disclosure.

As shown in FIG. 13, in the related art, only the odd-numbered display lines were driven in the first sub-frame SF1 scan, and only the even-numbered display lines were driven in the second sub-frame SF2 scan. Hence, in the related art, a kickback voltage $\Delta Vp$ varied due to a difference between parasitic capacitances Cgs of adjacent display lines. As a result, a luminance varied in a cycle of one sub-frame, and the luminance deviation was perceived as 30 Hz flicker.

On the other hand, the embodiment of the invention drives a pair of display lines including the adjacent odd-numbered and even-numbered display lines through the 2-line interlaced low speed driving scheme in each of the first and second sub-frame SF1 and SF2 in consideration of a difference between parasitic capacitances Cgs of the adjacent odd-numbered and even-numbered display lines, thereby solving a luminance deviation $\Delta L$ between the adjacent sub-frames.

As described above, the embodiment shown in (B) of FIG. 13 uses a 60 Hz flicker component by adopting the 2-line interlaced low speed driving scheme, as opposed to the 30 Hz flicker component used in the related art shown in (A) of FIG. 13. Because the 60 Hz flicker component is not perceived by human eyes, the 60 Hz flicker component does not affect the display quality of the display device.

In some embodiments, by adopting the 2-line interlaced low speed driving scheme according to the disclosure, flicker values measured at a plurality of measurement points of the display panel 10 can be reduced, as compared with the related art. Further, a flicker deviation between the measurement points can be greatly reduced, as compared with the related art.

Further, as can be seen from FIGS. 14A and 14C, the embodiment of the disclosure adopts the 2-line interlaced low speed driving scheme, thereby causing the transition of data (shown in FIG. 14C) during the interlaced low speed drive to be similar to the transition of data (shown in FIG. 14A) during the normal drive.

In FIGS. 14A to 14C, a white gray level is represented by a white pattern, and a black gray level is represented by an oblique line pattern. Because the transition number of data in the related art interlaced low speed driving scheme shown in FIG. 14B is less than the transition number of data in the normal driving method shown in FIG. 14A, a charge amount of data in FIG. 14B is more than a charge amount of data in FIG. 14A. Thus, although the data voltage of the same gray level is applied in FIGS. 14A and 14B, a display luminance in FIG. 14B is greater than a display luminance in FIG. 14.

On the other hand, these embodiments cause the transition number of data during one frame in the interlaced low speed driving scheme shown in FIG. 14C to be similar to the transition number of data in the normal driving method shown in FIG. 14A by adopting the 2-line interlaced low speed driving scheme. These embodiments minimize a difference between a charge amount of data in the interlaced low speed driving scheme shown in FIG. 14C and a charge amount of data in the normal driving method shown in FIG. 14A. Hence, these embodiments improve the luminance deviation at all gray levels when the driving mode is converted in a display unit of a single color (for example, green), as compared with the related art.

In the related art, although the data voltage of the same gray level is applied, the luminance deviation between the driving modes shows a large value at each gray level. However, these embodiments greatly reduce the luminance deviation at each gray level.

As described above, these embodiments change the frame frequency in response to the mode conversion control signal and alternate the normal driving mode and the interlaced low speed driving mode. Further, these embodiments adopt the 2-line interlaced low speed driving scheme so as to implement the interlaced low speed driving mode, thereby minimizing the visibility of the luminance deviation when the driving mode is converted while displaying the same pattern of a single color and minimizing the visibility of the flicker in the interlaced low speed driving state.

Furthermore, these embodiments adjust one gate time and the rising time of the scan pulse during the interlaced low speed drive, thereby completing the scanning operation during a portion (i.e., the scan period) of each sub-frame. Further, these embodiments prevent the static current of the source driver from being generated during the remaining period (e.g., the skip period) of each sub-frame, thereby greatly reducing power consumption.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device capable of driving at low speed, which changes a frame frequency in response to a mode conversion control signal, the display device comprising:

a display panel, on which a plurality of pixels are formed, pixels connected to a first data line on odd-numbered display lines of the display panel being positioned on one side of the left and right sides of the first data line based on a Z-inversion scheme, pixels connected to the first data line on even-numbered display lines of the display panel being positioned on the other side of the first data line based on the Z-inversion scheme;

a driver unit configured to drive the plurality of pixels; and a timing controller configured to, responsive to the mode conversion control signal for switching to an interlaced low speed driving mode being received during a normal drive, in which a length of one frame is set to P:

expand a length of one frame for a low speed drive to (n×P), where n is a positive integer equal to or greater than 2, assign a length P to each of n sub-frames included in the one frame for the low speed drive, group a plurality of display line pairs into n display line pair groups, each display line pair group including two adjacent display lines, and respectively drive the n display line pair groups in the n sub-frames in an interlaced low speed driving scheme by controlling an operation of the driver unit such that each display line pair group of a respective sub-frame is driven during a first part of the length P assigned to said respective sub-frame and no display line is driven during a second part of the length P assigned to said respective sub-frame.

2. The display device of claim 1, wherein the driver unit includes a gate driver for driving gate lines of the display panel and a source driver for driving data lines of the display panel, wherein in the interlaced low speed driving mode, the timing controller:

groups a plurality of gate line pairs each including two adjacent gate lines into n groups, respectively drives the n gate line pair groups in the n sub-frames in the interlaced low speed driving scheme by controlling an operation of the gate driver, completes a scanning operation, during a scan period corresponding to the first part of the length P assigned to said respective sub-frame, of gate lines belonging to a corresponding gate line pair group, generates a buffer operation control signal, and shuts off a driving power source applied to buffers of the source driver during a skip period corresponding to the second part of the length P assigned to said respective sub-frame.

3. The display device of claim 2, wherein in the interlaced low speed driving mode, the timing controller changes a polarity control signal, expands a polarity inversion period of a data voltage, for input to the display panel, to one frame for the low speed drive, controls an operation of the source driver, outputs the data voltage to the data lines during the scan period, and skips an output of the data voltage during the skip period.

4. The display device of claim 3, wherein the source driver outputs data voltages of opposite polarities through adjacent output channels in a column inversion scheme and inverts a polarity of each output channel in a cycle of one frame for the low speed drive in response to the polarity control signal.

5. The display device of claim 2, wherein the scan period occupies 1/n of each sub-frame, and the skip period following the scan period occupies (n−1)/n of each sub-frame.

6. The display device of claim 2, wherein the timing controller sets one gate time required to scan one gate line in each sub-frame to '1H' defined by the length P of one sub-frame/the number of gate lines and sets a distance between rising edges of adjacent scan pulses scanned in an interlaced scheme in one sub-frame to '1H', so as to secure the skip period in the interlaced low speed driving mode.

7. The display device of claim 2, wherein a scanning operation of the gate driver and a data voltage supply operation of the source driver are skipped during the skip period of each sub-frame.

8. The display device of claim 1, wherein the first part of the length P assigned to said respective sub-frame is 1/n of P and the second part of the length P assigned to said respective sub-frame is (n−1)/n of P.

9. The display device of claim 1, wherein the second part is subsequent to the first part.

10. The display device of claim 1, wherein the second part is a remainder of the length P assigned to said respective sub-frame other than the first part.

11. The display device of claim 1, wherein the driver unit includes a source driver for driving data lines of the display panel and a buffer of the source driver is turned off during the second part of the length P assigned to said respective sub-frame.

12. A method of driving a display device capable of driving at low speed, which changes a frame frequency in response to a mode conversion control signal, the method comprising:

driving a plurality of pixels formed on a display panel of the display device, pixels connected to a first data line on odd-numbered display lines of the display panel being positioned on one side of the left and right sides of the first data line based on a Z-inversion scheme, pixels connected to the first data line on even-numbered display lines of the display panel being positioned on the other side of the first data line based on the Z-inversion scheme;

responsive to the mode conversion control signal for switching to an interlaced low speed driving mode being received during a normal drive, in which a length of one frame is set to P:

expanding a length of one frame for a low speed drive to (n×P), where n is a positive integer equal to or greater than 2, assigning a length P to each of n sub-frames included in the one frame for the low speed drive, grouping a plurality of display line pairs into n display line pair groups, each display line pair group including two adjacent display lines, and respectively driving the n display line pair groups in the n sub-frames in an interlaced low speed driving scheme by controlling an operation of the driver unit such that each display line pair group of a respective sub-frame is driven during a first part of P assigned to said respective sub-frame and no display line is driven during a second part of the length P assigned to said respective sub-frame.

13. The method of claim 12, wherein the display device includes a gate driver for driving gate lines of the display panel and a source driver for driving data lines of the display panel, and the method further comprising:

in the interlaced low speed driving mode:

grouping a plurality of gate line pairs each including two adjacent gate lines into n groups, respectively driving the n gate line pair groups in the n sub-frames in the interlaced low speed driving scheme by controlling an operation of the gate driver, completing a scanning operation, during a scan period corresponding to the first part of the length P assigned to said respective sub-frame, of gate lines belonging to a corresponding gate line pair group, generating a buffer operation control signal, and shutting off a driving power source applied to buffers of the source driver during a skip period corresponding to the second part of the length P assigned to said respective sub-frame.

14. The method of claim 13, further comprising:

in the interlaced low speed driving mode:

changing a polarity control signal;

expanding a polarity inversion period of a data voltage, for input to the display panel, to one frame for the low speed drive;

controlling an operation of the source driver;

outputting the data voltage to the data lines during the scan period; and skipping an output of the data voltage during the skip period.

15. The method of claim 14, further comprising outputting data voltages of opposite polarities through adjacent output channels in a column inversion scheme and inverting a polarity of each output channel in a cycle of one frame for the low speed drive in response to the polarity control signal.

16. The method of claim 13, wherein the scan period occupies 1/n of each sub-frame, and the skip period following the scan period occupies (n−1)/n of each sub-frame.

17. The method of claim 13, further comprising setting one gate time required to scan one gate line in each sub-frame to '1H' defined by the length P of one sub-frame/the number of gate lines and setting a distance between rising edges of adjacent scan pulses scanned in an interlaced scheme in one sub-frame to '1H', so as to secure the skip period in the interlaced low speed driving mode.

18. The method of claim 13, further comprising skipping a scanning operation of the gate driver and a data voltage supply operation of the source driver during the skip period of each sub-frame.

19. The method of claim 12, The display device of claim 1, wherein the first part of the length P assigned to said respective sub-frame is 1/n of P and the second part of the length P assigned to said respective sub-frame is (n−1)/n of P.

20. The method of claim 11, wherein the display device includes a source driver for driving data lines of the display panel, and the method further comprising turning off a buffer of the source driver during the second part of the length P assigned to said respective sub-frame.

* * * * *